US007676975B2

(12) United States Patent
Phillips et al.

(10) Patent No.: US 7,676,975 B2
(45) Date of Patent: Mar. 16, 2010

(54) TACTICAL FOREGRIP ASSEMBLY

(75) Inventors: Darron Phillips, San Antonio, TX (US); Mark M. Ferris, San Antonio, TX (US); Arthur F. Gonthier, Victoria, TX (US)

(73) Assignee: Breaching Technologies, Inc., San Antonio, TX (US)

( * ) Notice: Subject to any disclaimer, the term of this patent is extended or adjusted under 35 U.S.C. 154(b) by 0 days.

(21) Appl. No.: 12/037,705

(22) Filed: Feb. 26, 2008

(65) Prior Publication Data

US 2009/0044439 A1 Feb. 19, 2009

Related U.S. Application Data

(60) Provisional application No. 60/956,264, filed on Aug. 16, 2007.

(51) Int. Cl.
*F41G 1/35* (2006.01)

(52) U.S. Cl. ..... 42/72; 42/84

(58) Field of Classification Search ..... 42/71.01, 42/72, 73, 94, 84, 90, 146; 248/171; 89/1.42; 362/110, 114
See application file for complete search history.

(56) References Cited

U.S. PATENT DOCUMENTS 2,597,565 A * 5/1952 Chandler et al. ..... 362/110
4,392,723 A * 7/1983 Gehmann ..... 359/501
4,502,238 A * 3/1985 Farrar et al. ..... 42/72
5,068,992 A * 12/1991 Velezis et al. ..... 42/72
5,237,773 A * 8/1993 Claridge ..... 42/117
5,417,002 A * 5/1995 Guerra ..... 42/72
5,426,882 A * 6/1995 Dornaus ..... 42/137
6,345,464 B1 * 2/2002 Kim et al. ..... 42/114
6,622,416 B2 * 9/2003 Kim ..... 42/146
7,243,454 B1 * 7/2007 Cahill ..... 42/72
7,441,364 B2 * 10/2008 Rogers et al. ..... 42/146
2006/0064913 A1 * 3/2006 Gablowski et al. ..... 42/72
2008/0148619 A1 * 6/2008 Rogers et al. ..... 42/90

* cited by examiner

*Primary Examiner*—Michael Carone
*Assistant Examiner*—Reginald Tillman, Jr.

(57) ABSTRACT

A tactical foregrip assembly for use with a firearm, the assembly having an independently rotatable grip mount assembly and an independently rotatable light mount assembly. The invention comprises a stationary mount assembly attachable to the receiver of a firearm, a grip mount assembly radially rotatable about and electrically coupled to the stationary mount assembly, and a light mount assembly radially rotatable about and electrically coupled to the stationary mount and engagable with said grip assembly. The present invention allows the operator to provide light to illuminate an area while simultaneously positioning himself in a manner so as to maximally use available cover.

24 Claims, 13 Drawing Sheets

TACTICAL FOREGRIP ASSEMBLY

CROSS REFERENCE TO RELATED APPLICATIONS

This original nonprovisional application claims the benefit of U.S. provisional application No. 60/956,264, filed Aug. 16, 2007 and entitled "Tactical Fore-End Assembly," which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to an accessory mounting platform for firearms. More specifically, the invention is a tactical foregrip assembly that provides a dynamically positionable foregrip in combination with an independently-positionable light assembly.

2. Description of the Related Art

Public safety and military personnel are often faced with the need to safely arrest and remove persons from structures that contain multiple rooms. Such room clearing operations, however, can be and often are life threatening situations in which an operator is vulnerable to receiving fire. Operator position, visibility, and time are critical in such operations.

Typical foregrip and accessory mounting systems do not allow the operator to rotate the grip or light so that the operator may optimize his or her position behind cover. For example, in a typical accessory mounting system, an attached light assembly is permanently mounted on a bottom rail or on one of two side rails affixed to the firearm. When mounted on a bottom rail, the weapon sling can often interfere with the projected light, which would require the operator to divert his or her attention from a threat or threat area to repositioning the sling. When mounted on a side rail, the orientation of the light causes unnecessary exposure to the operator when circumventing corners. For example, if the light is mounted on a left side rail, to negotiate a left turn (e.g., a 90-degree left turn in a hallway), the firearm must be positioned far enough into the hallway to allow the light to be projected down the threat area. If the operator desires to align an eye with the firearm sight, this results in increased exposure to the operator, who must rollout the firearm as well as his or her body around the turn further than in a well-lighted area. The same problem occurs when if the light is mounted on a right side rail and a right turn must be negotiated.

Similarly, the typical foregrip is fixed in a vertical direction. To drop to a maximally-prone position using a firearm with such a fixed vertical foregrip, the operator typically assumes a "rollover prone" position where the operator is laying sideways with one hand positioned underneath the weapon. This, however, alters the flight path of the bullet as it would be fired from an upright firing position. For example, a gun sighted in at one hundred yards in an upright position, when fired in the "rollover prone" position (e.g., aimed and fired sideways by the operator), must be aimed above and to the side of the target.

BRIEF SUMMARY OF THE INVENTION

The present invention is a tactical foregrip assembly comprising a stationary mount assembly attachable to the receiver of a firearm; a grip mount assembly radially rotatable about the stationary mount assembly, and a light assembly radially rotatable about and electrically coupled to the stationary mount assembly and engagable with the grip assembly. The grip mount assembly has a grip assembly incorporating an electrical switch for actuating the light assembly. The light mount assembly is independently rotatable relative to the grip assembly and is actuatable with the switch.

The present invention serves to improve the position, visibility and time response by allowing an operator to quickly place a light, laser, or other accessory to maximize visibility. The present invention also allows the operator to remain behind cover or low to the ground. In addition, the present invention allows a firearm operator to quickly switch between multiple rail-mounted accessories (e.g., switching between a close quarters battle sight and a high power scope) with or without rotating the foregrip assembly to a more favorable position.

DETAILED DESCRIPTION OF THE INVENTION

The present invention is a tactical foregrip assembly intended for use with, and longitudinally aligned on, the receiver of a firearm. As used herein, "proximal" means proximal to the muzzle of the firearm when the present invention is installed thereon, while "distal" means distal to the muzzle end of the firearm when the present invention is installed thereon.

Figure 1:
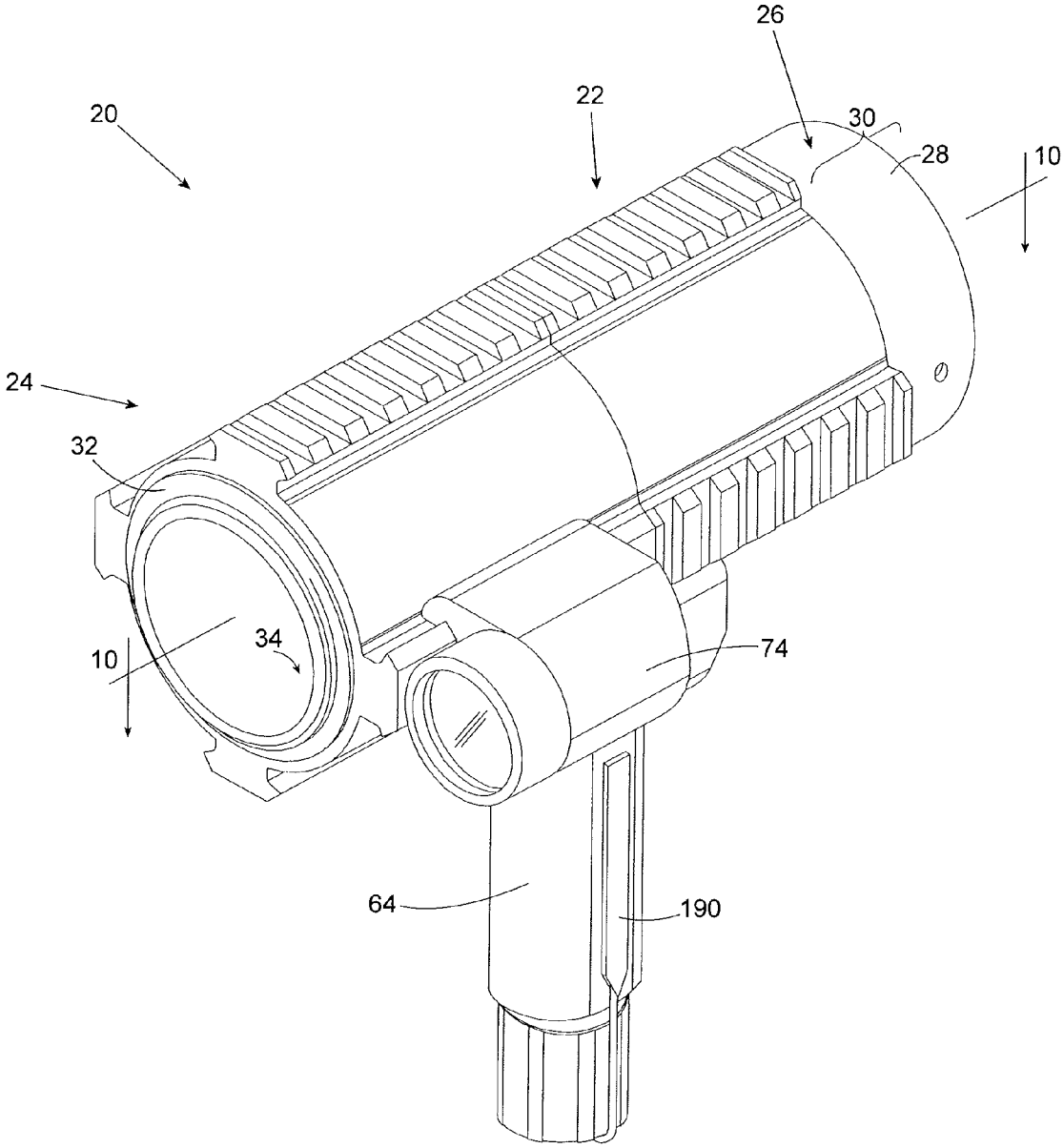
FIG. 1 is a perspective view of the preferred embodiment of the present invention.

FIG. 1 illustrates the preferred embodiment of the tactical foregrip assembly 20. A grip mount assembly 22 and a light mount assembly 24 are positioned about a stationary mount assembly 26 that is attachable to the receiver of a firearm. The stationary mount assembly 26 includes a nylon (30% glass filled) barrel mount 28 with a distal second portion 30 as well as a proximal first portion 34 about which the grip mount assembly 22 and light mount assembly 24 are positioned. A spring clip 32 fixed about the first portion 34 of the barrel mount 28 prevents movement of the grip mount assembly 22 and light mount assembly 24 toward the muzzle of the firearm, thus securing the grip mount assembly 22 and light mount assembly 24 between the spring clip 32 and the second portion 30.

The light mount assembly 24 of the preferred embodiment includes a light assembly 74 that is oriented to project light in the aiming direction of the firearm. The grip mount assembly 22 of the preferred embodiment includes a grip assembly 64 incorporating a pressure switch 190 to selectively deliver power to the light assembly 74 through a slip ring system, as will be described hereinafter.

Figure 2:
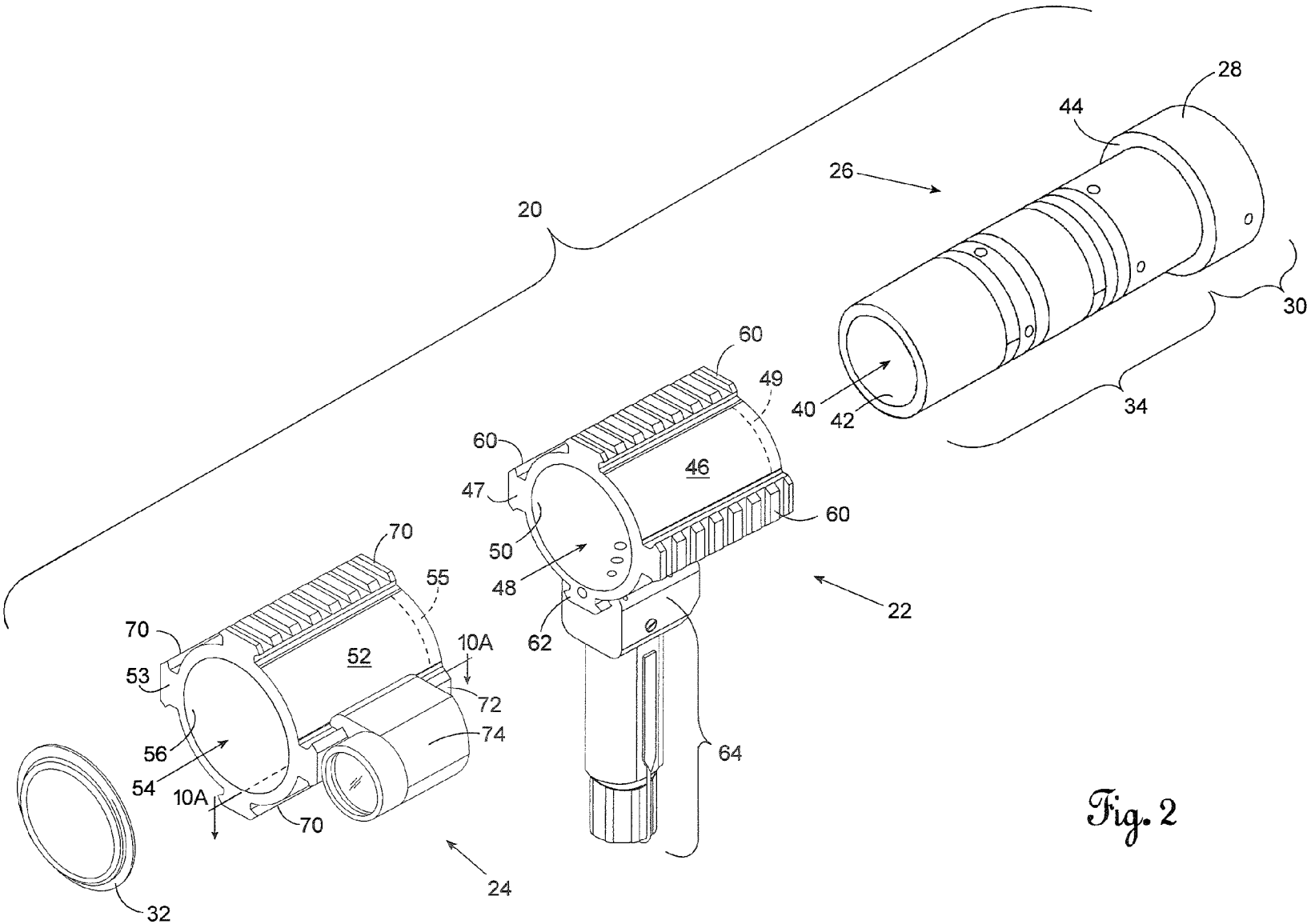
FIG. 2 is an exploded assembly view of the preferred embodiment of the present invention.

FIG. 2 discloses the interconnection between the major components of the preferred embodiment of the tactical foregrip assembly 20 in greater detail. As noted hereinabove, the foregrip assembly 20 comprises the stationary mount assembly 26 including the barrel mount 28 that encircles a cylindrical interior space 40 defined by an inner sidewall 42, which interior space 40 is positionable around the firearm barrel. The first portion 34 of the barrel mount 28 has a smaller outer diameter than the adjacent second portion 30. The intersection between first portion 34 and second portion 30 is defined by a circular shoulder 44.

The grip mount assembly 22 has a grip mount 46 having a proximal base surface 47 and a distal base surface 49, which grip mount 46 encircles an interior space 48 that is defined by a cylindrical sidewall 50. When assembled, the grip mount assembly 22 is positioned about the first portion 34 of the barrel mount 28 such that the first portion 34 occupies the interior space 48 and so that the distal base surface 49 is adjacent the shoulder 44. In this manner, the grip mount assembly 22 is impeded from sliding off the distal end of the barrel mount 28 by the shoulder 44.

The light mount assembly 24 has a light mount 52 that encircles an interior space 54 defined by a cylindrical interior sidewall 56. The light mount assembly 24 is positioned around the barrel mount 28 such that a proximal portion of the first portion 34 thereof occupies the interior space 54 and the distal base surface 55 contacts a proximal base surface 47 of the grip mount 46.

The grip mount 46 and light mount 52 each comprise a number of mounting rails for mounting various firearm-related accessories. The grip mount 46 includes three accessory mounting rails 60 meeting military standard MIL-STD-1913, which is incorporated herein by reference. In addition, the grip mount 46 includes a grip mounting rail 62 to which is secured to the grip assembly 64 that will be described in greater detail hereinafter. The three accessory mounting rails 60 and grip mounting rail 62 extend from and are equally circumferentially spaced around the exterior surface of the grip mount 46, and are aligned parallel to one another.

Similarly, the light mount 52 includes three accessory mounting rails 70 meeting the standards defined by MIL-STD-1913 and a light mounting rail 72 that extend from and are equally circumferentially spaced around the exterior surface of the light mount 52 and run parallel to one another. A light assembly 74 is secured to the light mounting rail 72. Operation and construction of the light assembly 74 will be more fully described hereinafter.

Prior to sliding the grip mount assembly 22 and light mount assembly 24 onto the first portion 34 of the barrel mount 28, a thin coat of white lithium grease (not shown) or comparable lubricant is applied to the interior sidewalls 50, 56 of the grip mount 46 and light mount 52, respectively. The lithium grease eases the rotation of the light mount assembly 24 and/or grip mount assembly 22 relative to the stationary mount assembly 26, as will be described hereinafter. The spring clip 32 is positioned adjacent the proximal base surface 53 of the light mount 52 to prevent inadvertent separation of the grip mount assembly 22 and light mount assembly 24 from the first portion 34 of the barrel mount 28.

Figure 3:
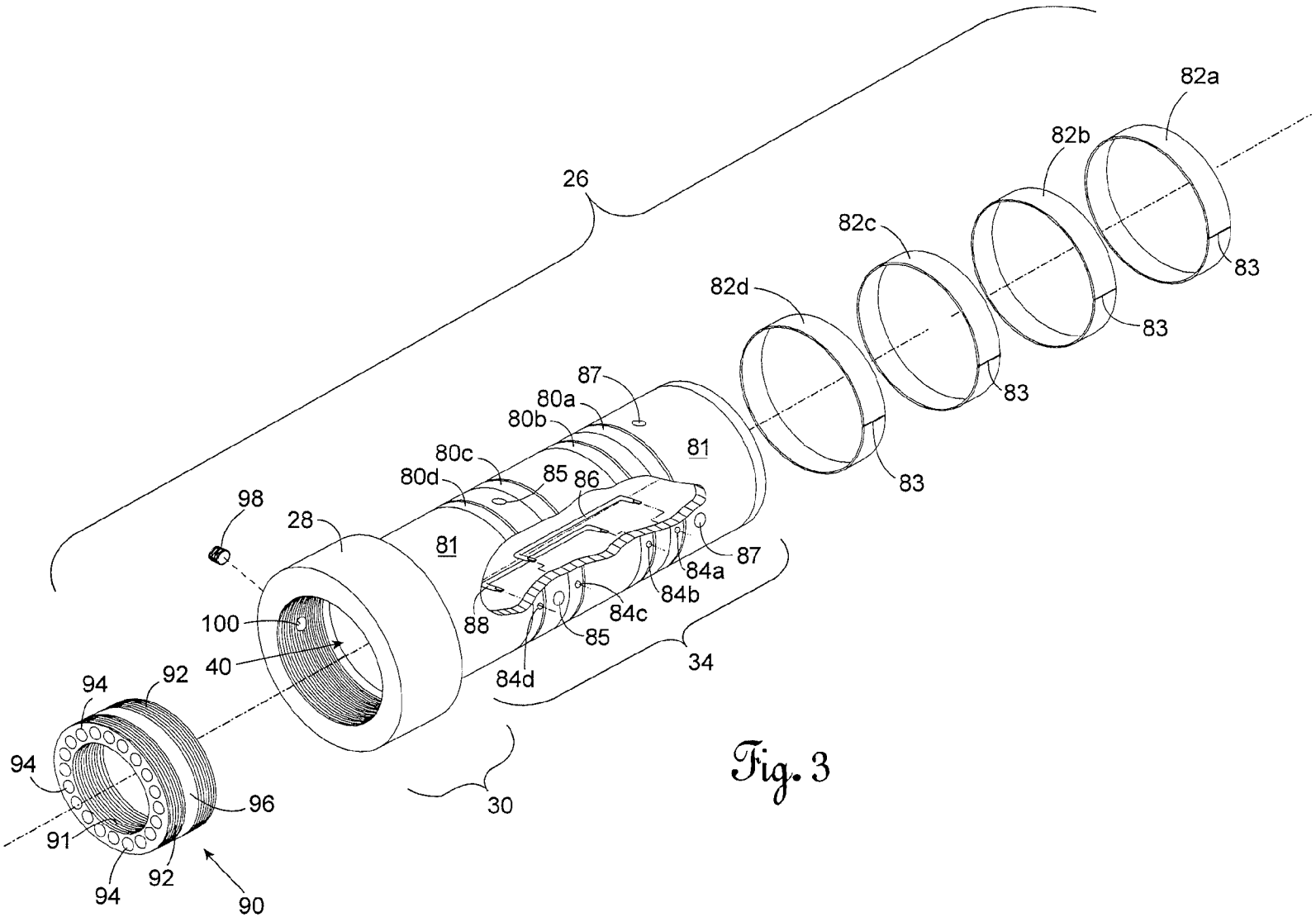
FIG. 3 is an assembly rear view of the stationary mount assembly of the preferred embodiment with a portion of the barrel mount cutaway.

FIG. 3 is an assembly rear view of the stationary mount assembly 26 of the preferred embodiment, which includes the barrel mount 28 enclosing the cylindrical interior space 40. As noted above, the first portion 34 of the barrel mount 28 has a smaller outer diameter than the adjacent second portion 30.

Four conductive slip rings 82*a*-82*d* are positioned within four corresponding slip ring grooves 80*a*-80*d* formed in the outer surface 81 of the first portion 34. The slip rings 82*a*-82*d* are not complete rings, but incorporate breaks 83 to allow for slight deformation of the slip rings 82*a*-82*d* when moved over the larger outer surface 81 of the barrel mount 28 and into the corresponding slip ring grooves 80*a*-80*d*. The slip rings 82*a*-82*d* of the preferred embodiment meet AISI 304 standards and are 0.250×0.030 flat.

Four wire holes 84*a*-84*d*, corresponding to the slip rings grooves 80*a*-80*d*, are disposed through the first portion 34 to provide access from the slip rings grooves 80*a*-80*d* to the interior space 40 of the barrel mount 28. An insulated negative wire 86 and an insulated positive wire 88 provide electrical coupling between the slip rings 82*a*-82*d*. Specifically, the ends of the negative wire 86 are disposed through the first and third wire holes 84*a*, 84*c*, respectively, such that when the first and third slip rings 82*a*, 82*c* are positioned in the first and third slip ring grooves 80*a*, 80*c*, respectively, they are electrically connected with the negative wire 86. Similarly, the ends of the positive wire 88 are disposed through the second and fourth wire holes 84*b*, 84*d*, respectively, such that when the second and fourth slip rings 82*b*, 82*d* are positioned in the second and fourth slip ring grooves 80*b*, 80*d*, respectively, they are electrically connected with the positive wire 88. The negative and positive wires 86, 88 are positioned in the interior space 40 of the barrel mount 28 and are mechanically and electrically bonded to the slip rings 82*a*-82*d* with an alumina bonding agent. In addition, all threaded attachments of the stationary mount assembly 26 are supplemented with a thread locking agent.

Four distal detents 85 are disposed into and equally circumferentially spaced around the outer surface of the barrel mount 28 between the third and fourth slip ring grooves 80*c*, 80*d*. Similarly, four proximal detents 87 are aligned proximally from the first slip ring groove 80*a*. Each of the distal and proximal detents 85, 87 extends into the outer surface 81 of the barrel mount 28, but does not provide access to the interior space 40 thereof. Operation of the distal detents 85 and proximal detents 87 with bearing balls will be described hereinafter with reference to the grip mount assembly 22 and light mount assembly 24.

The stationary mount assembly 26 further includes a cylindrical barrel nut 90 having internal threads 91 for securing to a threaded receiver of a firearm and outer threads 92 for engagement to the internally-threaded second portion 30 of the barrel mount 28. Vent holes 94 are disposed through the barrel nut 90 parallel to its cylindrical axis to allow air circulation between the barrel mount 28 and the firearm receiver, which helps prevent the barrel and barrel mount 28 from overheating during periods of rapid firing. A flattened area 96 on the outer sidewall of the barrel nut 90 is engaged by a set screw 98 through a set screw hole 100 disposed through the second portion 30 of the barrel mount 28. This engagement helps prevent inadvertent loosening of the barrel mount 28 from the barrel nut 90.

In the preferred embodiment, the barrel nut 90 is part number AR1FF, available from Olympic Arms, Inc., and results in a cantilevered attachment with the firearm in that the only point of contact with the receiver is via the internally-threaded second portion 28 of the barrel nut 90. Alternative embodiments of the invention, however, contemplate stationary mounts using alternative means of attachment to the receiver, such as the retention pin methodology often used in firearms manufactured by Heckler & Koch.

Figure 4:
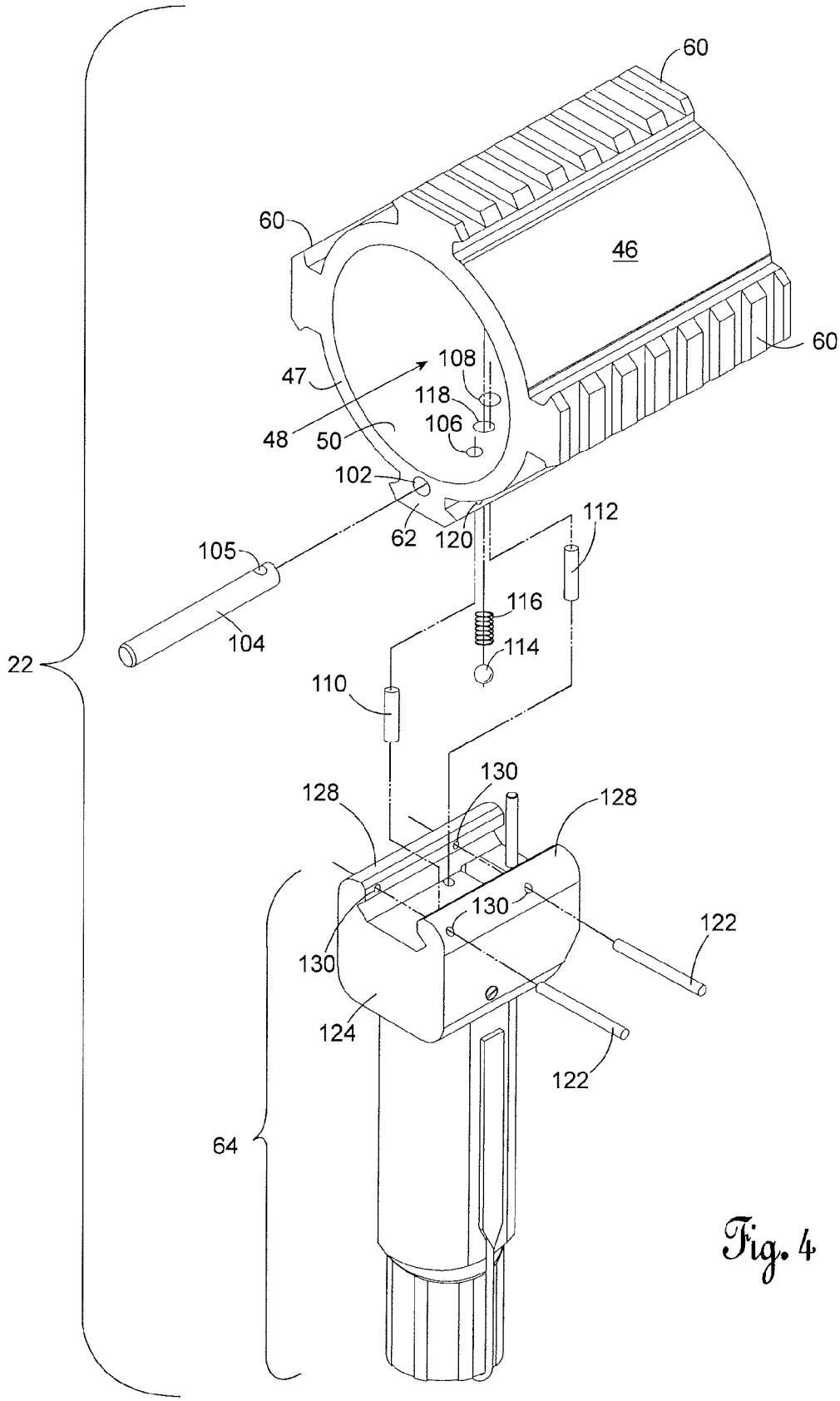
FIG. 4 is an assembly front view of the grip mount assembly of the preferred embodiment.

FIG. 4 is an assembly front view of the grip mount assembly 22 of the preferred embodiment, which includes the grip assembly 64 secured to the grip mount 46. As noted hereinabove, the grip mount 46 includes three accessory mounting rails 60 and a grip mounting rail 62, which are equally spaced about the outer surface and oriented parallel to the cylindrical axis of the grip mount 46. A release pin hole 102 is disposed in the proximal base surface 47 to receive a horizontal release pin 104 with an engagement hole 105 disposed therethrough.

First and second grip conductor holes 106, 108 are disposed through the sidewall 50 of the grip mount 46 and through the grip mounting rail 62 to provide access from the grip mounting rail 62 to the interior space 48 of the grip mount 46. The first grip conductor hole 106 is aligned to allow a first grip conductor pin 110 to protrude through the inner sidewall 50 and contact the third slip ring 82*c* (see FIG. 3) of the stationary mount assembly 26. Similarly, the second grip conductor hole 108 is aligned to allow a second grip conductor pin 112 to protrude through the inner sidewall 50 and contact the fourth slip ring 80*d* (see FIG. 3). This provides electrical coupling between a voltage source housed within the grip assembly 64 to the third and fourth slip rings 82*c*, 82*d*, regardless of its rotational position relative to the grip mount assembly 22.

A grip bearing ball 114 and grip bearing spring 116 are also positioned within a grip bearing hole 119 (not shown) disposed into sidewall 50 of the grip mount 46. Opposite the grip bearing hole 119, two mounting holes 120 are disposed through the grip mounting rail 62 transversely to the cylindrical axis of the grip mount 46 to receive two grip mounting pins 122. To bore the grip bearing hole 119, a drill access hole 118 is first disposed through the sidewall 50 opposite the location of the grip bearing hole 119. An appropriately sized drill bit may then be place through the drill access hole 118 to drill the grip bearing hole 119 into the sidewall 50.

The grip bearing hole 119 is alignable with the distal detents positioned between 85 the third and fourth slip ring grooves 80*c*, 80*d* of the barrel mount 28. As the grip mount assembly 22 is rotated around the barrel mount 28 to a position wherein a distal detent 85 is aligned with the grip bearing hole 119, the grip bearing spring 116 expands against the grip mount 46 to urge the grip bearing ball 114 into the aligned distal detent 85. When positioned in a distal detent 85, the grip bearing ball 114 resists rotational movement of the grip mount 46 relative to the barrel mount 28. While this resistance can be easily overcome causing the grip bearing ball 114 to recede from the distal detent 85, it is sufficient to aid in the inadvertent rotation of the grip mount 46.

The grip assembly 64 includes a mounting bracket 124 having two bracket fingers 128 shaped to affix to the grip mounting rail 62. The bracket fingers 128 are inwardly-angled to form a shape complimentary to the profile of the grip mounting rail 62 such that, once positioned thereon, the shape of the mounting bracket 124 and bracket fingers 128 prevents movement in a direction other than longitudinally relative to the grip mount 46. Two pairs of aligned mounting holes 130 are disposed through the bracket fingers 128, each pair aligning with a mounting hole 120 disposed through the grip mounting rail 62. The grip mounting pins 122 are positioned in the aligned pairs of mounting holes 120, 130 to immobilize the grip assembly 64 relative to the grip mount 46. A bonding agent is applied to the mounting pins 122 to prevent inadvertent removal of the grip mounting pins 122.

Figure 5:
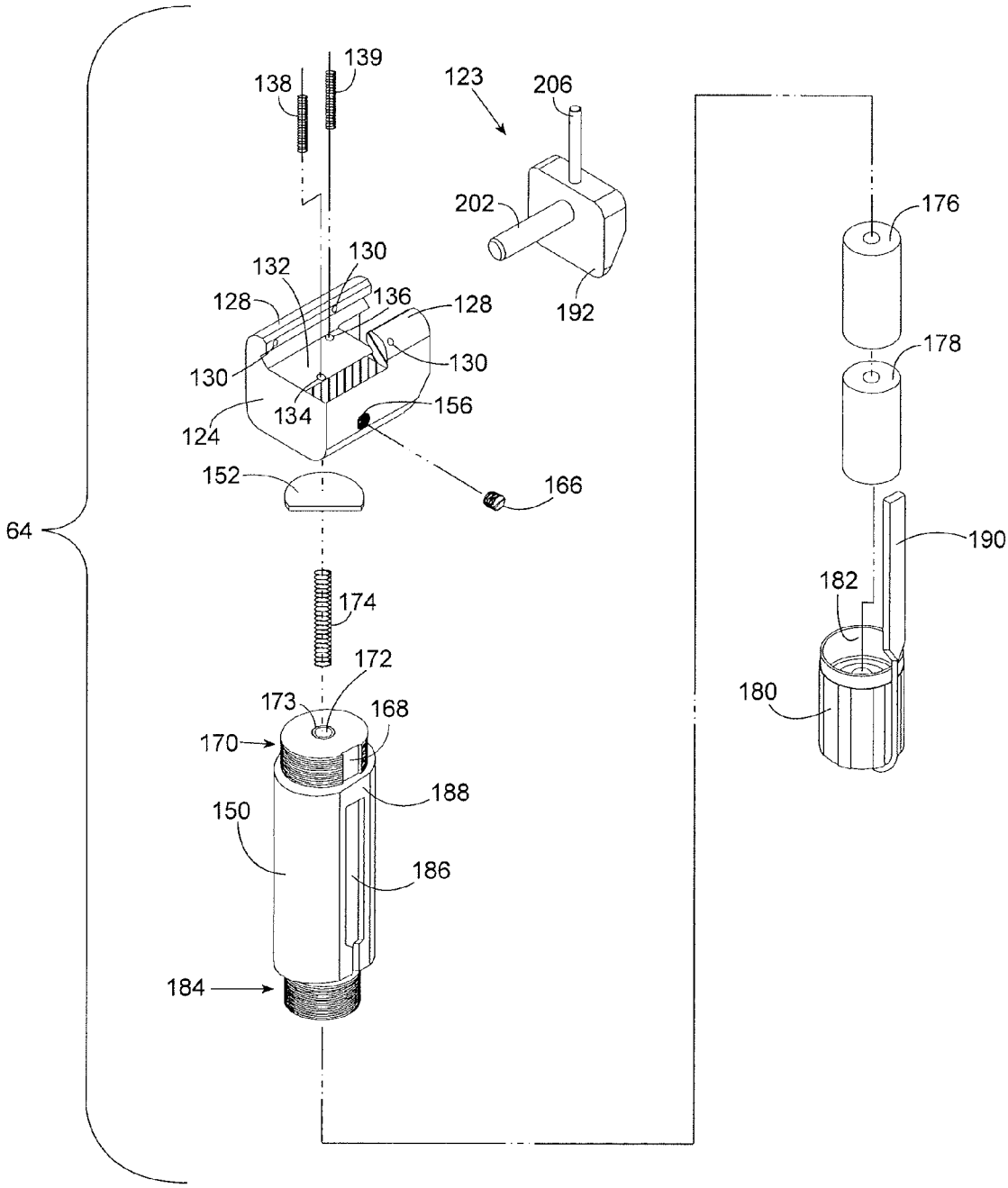
FIG. 5 is an exploded assembly view of the grip assembly of the preferred embodiment.

FIG. 5 is an assembly view of the grip assembly 64 with a partial sectional view of the mounting bracket 124. As noted hereinabove, the mounting bracket 124 includes two bracket fingers 128 that slide over the grip mounting rail 62 of the grip mount 46 (see FIG. 4). The bracket fingers 128 are inwardly-angled to form a shape complimentary to the profile of the grip mounting rail 62 such that, once positioned thereon, the shape of the mounting bracket 124 and bracket fingers 128 prevents movement in a direction other than longitudinally relative to the grip mount 46. First and second grip compression springs 138, 139 are placed in each of the first and second spring holes 134, 136 to bias the first and second grip conductor pins 110, 112 toward the interior space 48 of the grip mount 46 (see FIG. 4), thus ensuring consistent and quality electrical coupling with the third and fourth slip rings 82*c*, 82*d* disposed around the barrel mount 28 (see FIG. 3 and FIG. 4).

The grip assembly 64 also includes a release button assembly 123 comprising a guide pin 202 and vertical release pin 206 for enabling selective radial rotation of the light mount assembly 24 relative to the grip mount assembly 22, as will be described in greater detail hereinafter. The guide pin 202 engages the mounting bracket 124 as will be described with reference to FIG. 6A through FIG. 6D.

Figure 6B:
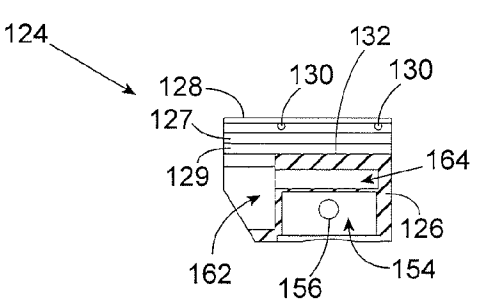
FIG. 6A through FIG. 6D are various views of the mounting bracket of the grip assembly.
Figure 6D:
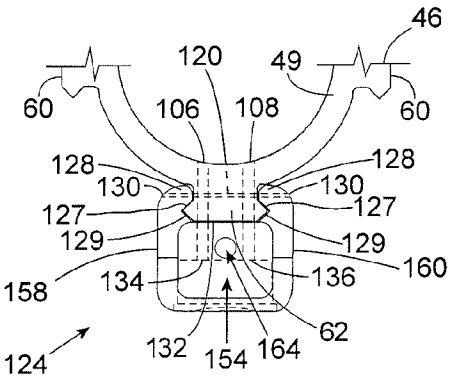
Figure 6A:
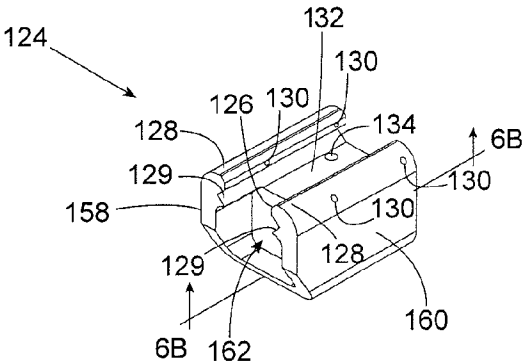
Figure 6C:
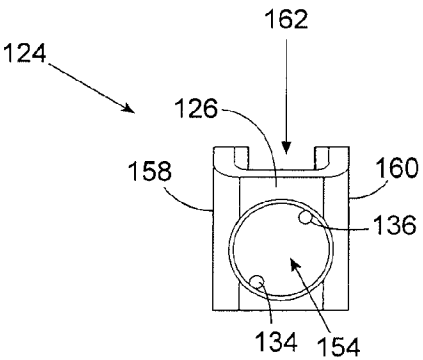

FIG. 6A through FIG. 6D more clearly show the mounting bracket 124 and its attachment to the grip mounting rail 62 of the grip mount 46. FIG. 6A is an isometric view of the mounting bracket 124. FIG. 6B is a sectional view through section line 6B-6B of FIG. 6A. FIG. 6C is a bottom elevation view of the mounting bracket 124. FIG. 6D is a rear elevation view showing the attachment of the mounting bracket 124 to the grip mount 46.

Two pairs of aligned mounting holes 130 are disposed through the bracket fingers 128. Each bracket finger 128 extends from a body 126 of the mounting bracket 124 and has first and second guide surfaces 127, 129 oriented perpendicularly to each other so that, when positioned on the grip mounting rail 62, movement other than longitudinally along the grip mounting rail 62 is prevented.

A mounting surface 132, which contacts the grip mounting rail 62, has first and second spring holes 134, 136 alignable with the first and second grip conductor holes 106, 108, respectively, providing paths to the interior space 48 of the grip mount 46. The first and second spring holes 134, 136 are disposed through the body 126 to provide access to a threaded recess 154 formed in the body 126.

A set screw hole 156 provides access into the recess 154 through a sidewall 158. The sidewalls 158, 160 of the mounting bracket 124 extend past the body 126 to form a button cavity 162 in which the release button 192 of the release button assembly 123 is guided, as will be described hereinafter. A guide pin slot 164, shaped to receive the guide pin 202 of the release button assembly 193 (see FIG. 5), is formed in the body 126 and is accessible from the button cavity 162.

Referring again to FIG. 5, a conductive grip 150 is engaged with the internally-threaded recess 154 of the mounting bracket 124. Prior to engaging the grip 150 with the mounting bracket 124, a conductive plate 152 is bonded to the body 126 within the recess 154 of the mounting bracket 124 using an appropriate bonding agent. The conductive plate 152 is shaped and positioned so that it can impede access to only one of the first spring hole 134 or second spring hole 136. An non-conductive bushing 173 prevents contact of the positively-charged compression spring 174 with the grip 150.

A set screw 166 is threaded into a set screw hole 156 to contact a flattened area 168 formed in the upper threaded portion 170 of the grip 150. Engagement of the set screw 166 with the flattened area 168 helps prevent inadvertent disengaging of the grip 150 from the mounting bracket 124. In addition, thread locker is applied to the set screw 166 prior to threading into the set screw hole 156. Moreover, the upper threaded portion 170 is sized so that the conductive grip 150 cannot be threaded so far into the mounting bracket as to contact the conductive plate 152, thus providing an air gap between the negatively-charged conductive grip 150 and positively-charged conductive plate 152 that prevents a short circuit.

A spring hole 172 provides access for a compression spring 174 to the interior of the grip 150. The compression spring 174 contacts the positive side of a first battery 176, the negative side of which is in contact with a second battery 178. A tail cap 180 has inner threads 182 to mate with a lower threaded portion 184 of the grip 150. The first and second batteries 176, 178 are contained by the grip 150 and electrically connected to the conductive plate 152 through the compression spring 174 to provide current thereto.

The grip 150 further includes a recessed portion 186 of the sidewall 188 shaped to receive a pressure switch 190 that is electrically connected to the tail cap 180. When threaded to the grip housing, the attached pressure switch 190 fits into the recessed portion 186 and is substantially flush therewith, but does not make electrical contact with the conductive grip 150 until urged to do so by the operator of the invention. Contact between the pressure switch 190 closes the electrical circuit to allow current to flow from the first and second batteries 176, 178 to the remaining components of the assembly. Although the preferred embodiment discloses a pressure-actuated pressure switch 190, displacement-actuated and force-actuated switches are also anticipated in alternative embodiments of the present invention.

Figure 7A:
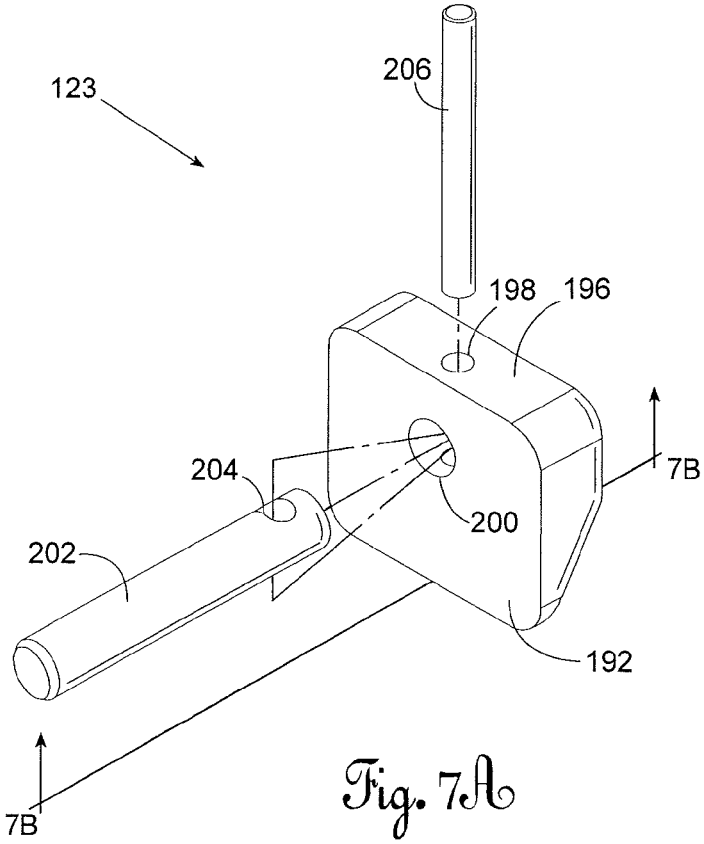
FIG. 7A are FIG. 7B depict the release button assembly of grip assembly in greater detail.
Figure 7B:
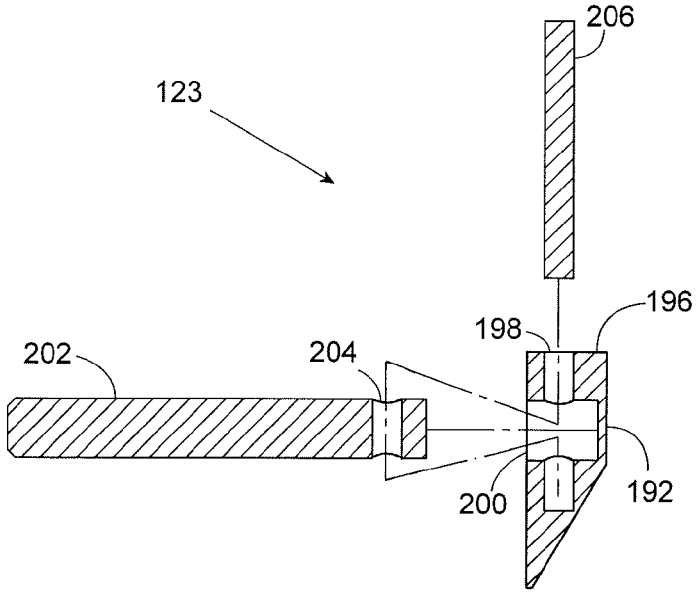

FIG. 7A and FIG. 7B are an assembly view and a sectional view through section line 7B-7B of FIG. 7A, respectively, of the release button assembly 123, which includes the release button. A release pin hole 198 is disposed through a top surface 196 and intersects with a transversely-bored guide pin hole 200. The guide pin 202 includes a bore hole 204 disposed therethrough that receives the vertical release pin 206. To assemble the release button assembly 123, the guide pin 202 is inserted into the guide pin hole 200 of the release button 192 until the bore hole 204 is aligned with the release pin hole 198. The vertical release pin 206 is then inserted into the release pin hole 198 until it intersects and extends through the bore hole 204 in the guide pin 202. The guide pin 202, release pin 206, and release button 192 are bonded together with an appropriate bonding agent.

Figure 8:
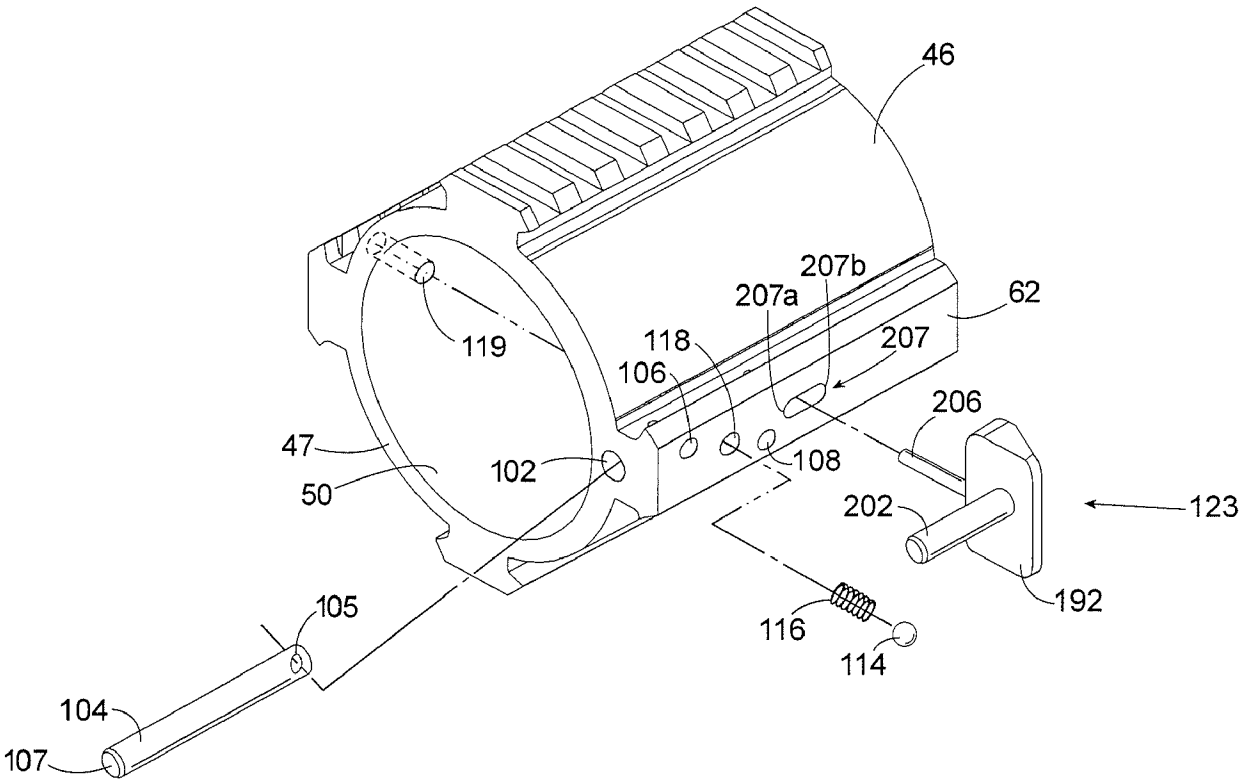
FIG. 8 is a rotated assembly drawing showing the connection between the release button assembly of the grip assembly and the horizontal release pin.

FIG. 8 more fully discloses the grip mounting rail 62 of the grip mount 46 and the relationship between the release button assembly 123 and the horizontal release pin 104. As described hereinabove, an engagement hole 105 is disposed through the horizontal release pin 104, which is positioned in the release pin hole 102 of the grip mount 46. The vertical release pin 206 extends through a release pin slot 207 in the grip mounting rail 62 and further through the engagement hole 105. As the release button assembly 123 is moved so that the vertical release pin 206 contacts either the proximal edge 207*a* or distal edge 207*b* of the release pin slot 207, the horizontal release pin 104 is caused to move in a corresponding manner because of its engagement with the vertical release pin 206.

When the release button assembly 123 is moved to a forward position wherein the vertical release pin 206 contacts the proximal edge 207*a* of the release pin slot 207, the proximal end 107 of the horizontal release pin 104 is substantially flush with the proximal base surface 47. Similarly, when the release button assembly 123 is moved to a rear position wherein the vertical release pin 206 contacts the distal edge 207*b*, the proximal end 107 of the horizontal release pin 104 is positioned within the release pin hole 102. Use of the release button assembly 123 to engage and disengage the light mount assembly 24 from the grip mount assembly 22 will be explained in greater detail hereinafter in reference to FIG. 10.

Figure 9A:
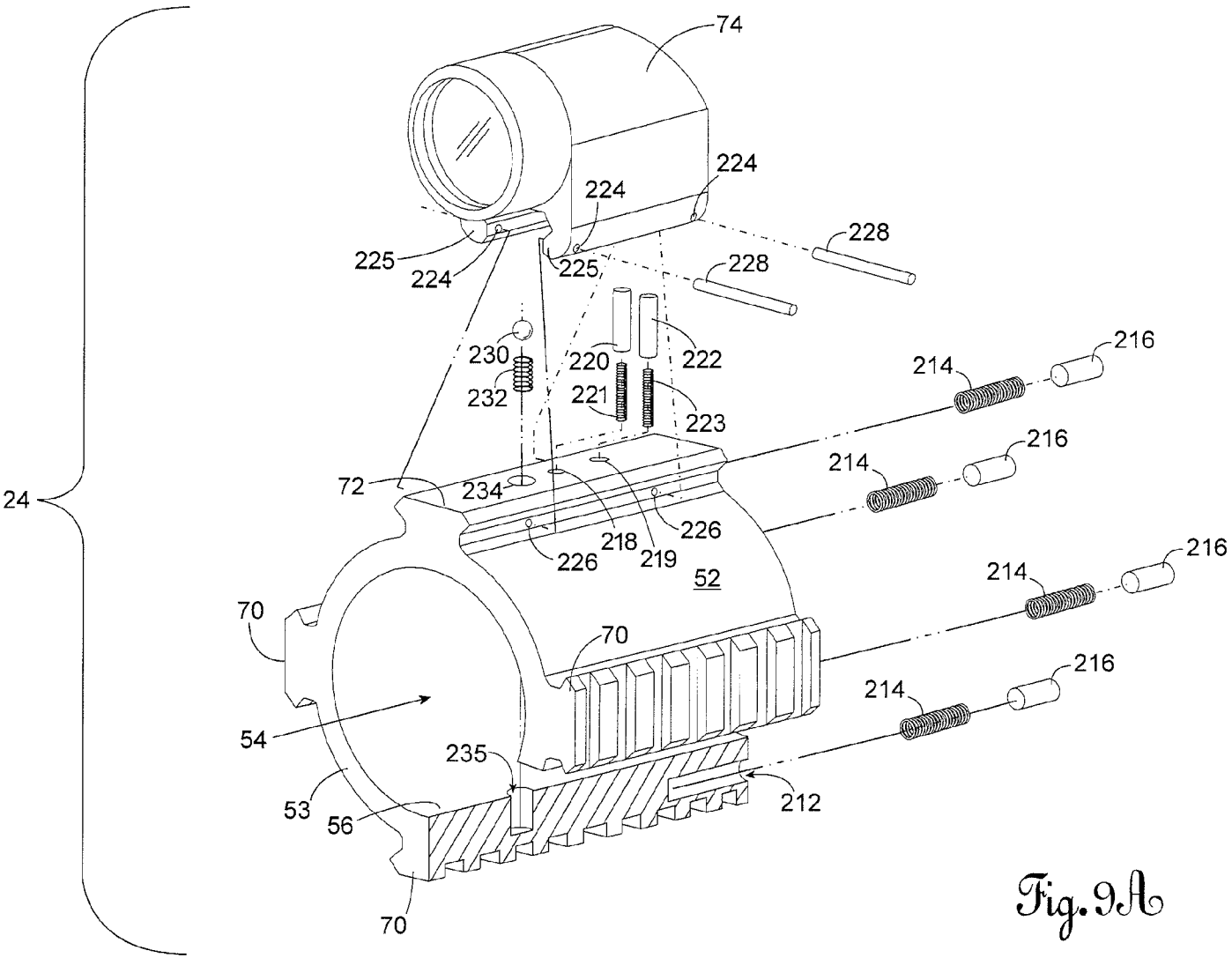
FIG. 9A is a partial sectional front perspective view of the light mount assembly through section line 9A-9A of FIG. 2.
Figure 9B:
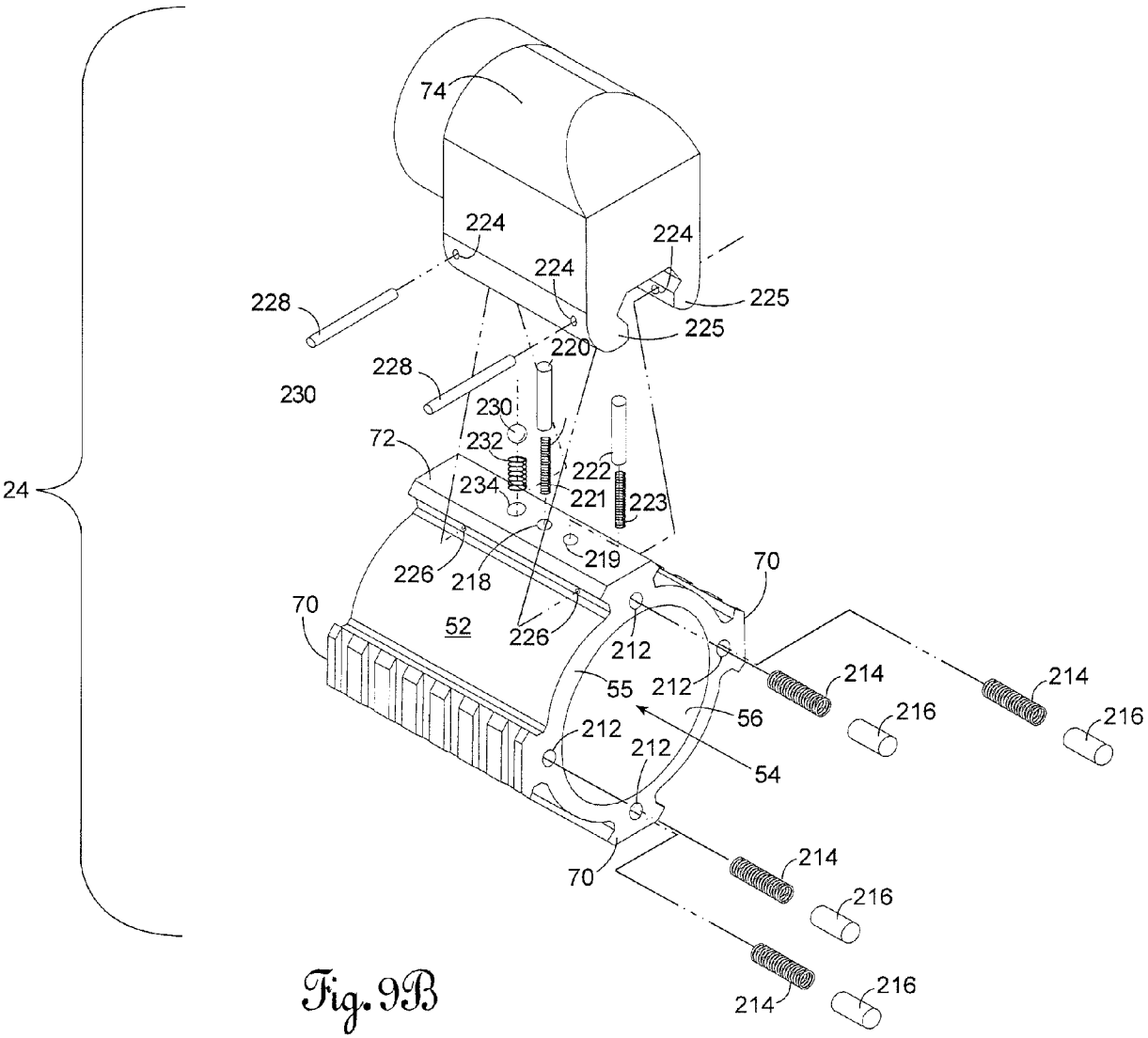
FIG. 9B is a rear perspective views of the light mount assembly of the preferred embodiment.

FIG. 9A and FIG. 9B depict front and rear perspective views, respectively, of the light mount assembly 24 of the preferred embodiment. As noted hereinabove, the light mount 52 is generally shaped as a hollow cylinder having a proximal base surface 53 and a distal base surface 55. The light mount 52 has three accessory mounting rails 70 and a light mounting rail 72 spaced equally about the exterior surface.

The distal base surface 55 includes four equally-spaced lock pin holes 212. Lock springs 214 are positioned in each of the lock pin holes 212 and compressed with lock pins 216. When positioned adjacent the grip mount assembly 22, at least three of the lock springs 214 will be compressed and each corresponding lock pin 216 completely recessed into its corresponding lock pin hole 212 by contact with the proximal base surface 47 of the grip mount 46. Each of the lock pin holes 212, the lock pins 216 therein, are alignable with the release pin hole 102 bored in the proximal base surface 47 by rotating the light mount assembly 24 about its longitudinal axis. In the preferred embodiment, the four lock pins 216 are spaced equally about the distal base surface 55, although in alternative embodiments any number of such lock pins 216 may be used to provide desired increments of rotation.

First and second light conductor pin holes 218, 219 are disposed through the light mounting rail 72, providing access to the interior space 54 of the light mount 52. The light conductor holes 218, 219 are positioned to allow first and second light conductor pins 220, 222 to contact the first and second slip rings 82*a*, 82*b* of the stationary mount assembly 26 (not shown). First and second compression springs 221, 223 urge the first and second light conductor pins 220, 222, respectively, from the first and second light conductor pin holes 218, 219 and toward the light assembly 74.

Two pairs of aligned mounting holes 224 are disposed through bracket fingers 225 of the light assembly 74 generally perpendicularly to the axis of the light mounting rail 72. The mounting holes 224 align with mounting holes 226 oriented transversely through the light mounting rail 72 and receive mounting pins 228 to secure the light assembly 74 to the light mounting rail 72. An appropriate bonding agent is applied to reduce the risk of the mounting pins 228 inadvertently being removed from the mounting pin holes 226, 228.

The light mount assembly 24 additionally includes a light bearing ball 230 and light bearing spring 232 disposed into a light bearing hole 235 in the sidewall 56. During manufacture, a drill access hole 234 is disposed through the light mounting rail 72 and providing access to the interior space 54. The light bearing hole 235 is alignable with the proximal detents 87 positioned proximally of the first slip ring grooves 80*a* of the barrel mount 28 (see FIG. 3). As the light mount assembly 24 is rotated around the barrel mount 28 to a position wherein a proximal detent 87 is aligned with the light bearing hole 235, the light bearing spring 232 expands against the light mount 52 and urges the light bearing ball 230 into the aligned proximal detent 87. When positioned in a proximal detent 87, the light bearing ball 230 resists rotational movement of the light mount 52 relative to the barrel mount 28. While this resistance can be easily overcome causing the light bearing ball 230 to recede from the proximal detent 87, it is sufficient to aid in the inadvertent rotation of the light mount 52 about the barrel mount 28 (see FIG. 3).

Figure 10A:
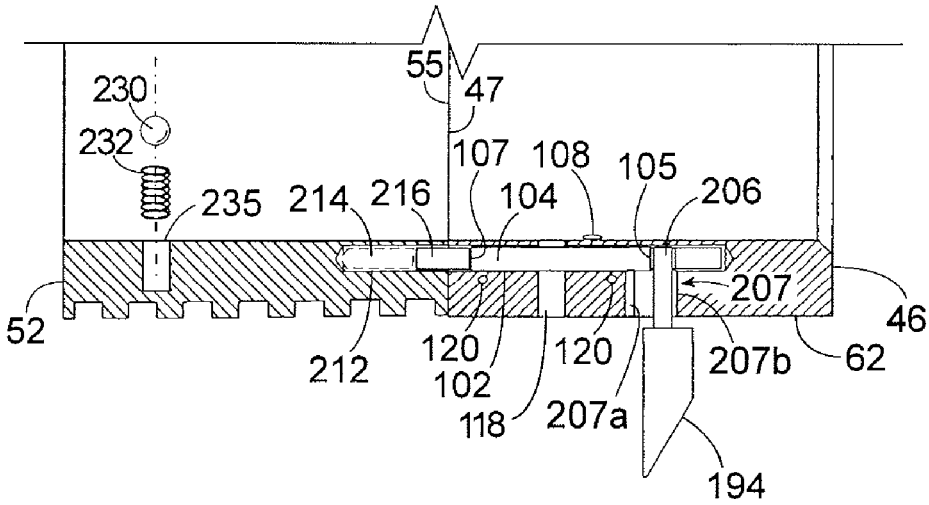
FIG. 10A and FIG. 10B are partial sectional drawings of the grip mount and light mount in the "engaged" and "disengaged" states.
Figure 10B:
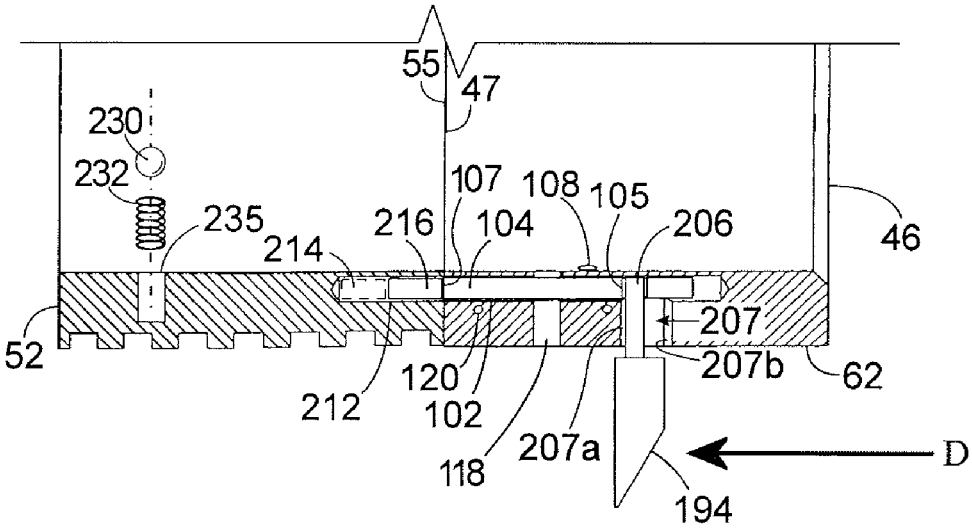

FIG. 10A and FIG. 10B in combination disclose in greater detail how operation of the release button 192 engages and disengages a lock pin 216 from the grip mount 46 to allow independent rotation of the light mount 24. FIG. 10A is a partial sectional view along section line 10-10 of FIG. 2, and which shows the light mount 24 engaged with the grip mount 46 to inhibit independent rotation. FIG. 10B is a partial sectional view that shows the light mount 24 disengaged from and freely rotatable relative to the grip mount 46. Although not related to operation of the release button 192, FIG. 10A and FIG. 10B also show the light bearing hole 235 and disposition of the light bearing spring 232 therein, which urges the light bearing ball 230 radially inward from the light mount 52.

As shown in FIG. 10A, and as described hereinabove, the light mount 52 includes lock pin holes 212 disposed in the distal base surface 55, each of which contains a lock spring 214 (represented for simplicity by a dashed box) exerting an expansive force on a lock pin 216. In the engaged position, a lock pin holes 212 is aligned with the release pin hole 102 in the proximal base surface 47 of the grip mount 46. Such alignment allows the lock spring 214 to expand and bias its corresponding lock pin 216 against the horizontal release pin 104 disposed in the release pin hole 102. Because the horizontal release pin 104 is engaged with the vertical release pin 206 of the release button assembly 123 (as described with reference to FIG. 8), the vertical release pin 206 is urged distally until further movement is impeded by the distal edge 207*b* of the release pin slot 207. In this "engaged" position, the lock pin 216 is partially disposed within its corresponding lock pin hole 212 and partially disposed within the release pin hole 102, thus preventing rotational movement of the light mount 52 relative to the grip mount 46. The lock pins 216 are made from material that will not shear in the event a user attempts to forces rotation of the light mount 52 while the in the "engaged" position.

As shown in FIG. 10B, to allow rotational movement of light mount 52 relative to the grip mount 46, the release button 192 is urged in a proximal direction D, which is opposite the direction of expansive force provided by the lock spring 214. When that expansive force is overcome, the engagement of vertical release pin 206 with horizontal release pin 104 forces the lock pin 216 into its corresponding lock pin hole 212, thus compressing the corresponding lock spring 214. Contact of the vertical release pin 206 with the proximal edge 207*a* of the release pin slot 207 inhibits further proximal movement, which aligns the proximal end 107 of the horizontal release pin 104 with the proximal base surface 47 of the grip mount 46. In this disengaged position, the light mount 52 may be rotated either direction about the barrel mount 28 (which, for simplicity, is not shown in FIG. 10A or 10B) until the next lock pin 216 aligns with the horizontal release pin 104. When so aligned, the expansive force of the lock spring 214 will force the horizontal release pin 104 into the release pin hole 102, thus re-engaging a lock pin 216 with the grip mount 46.

In the preferred embodiment, the release button assembly 123 is positioned on the distal side of the grip assembly 64 so that the thumb of the operator's non-firing hand is used to disengaged the light mount assembly 24 to minimize accidental disengagement. Pulling a firearm's trigger with the index finger of the firing hand often results in a reflexive reaction in the index finger of the non-firing hand such that, if the release button assembly 123 is positioned proximally of the grip assembly 64, accidental disengagement is more likely. Similarly, the reverse is true, wherein actuating a proximally mounted release button with the non-firing index finger could cause a reflexive squeezing of the trigger with the index finger of the firing hand, resulting in accidental firing of the weapon.

Figure 11:
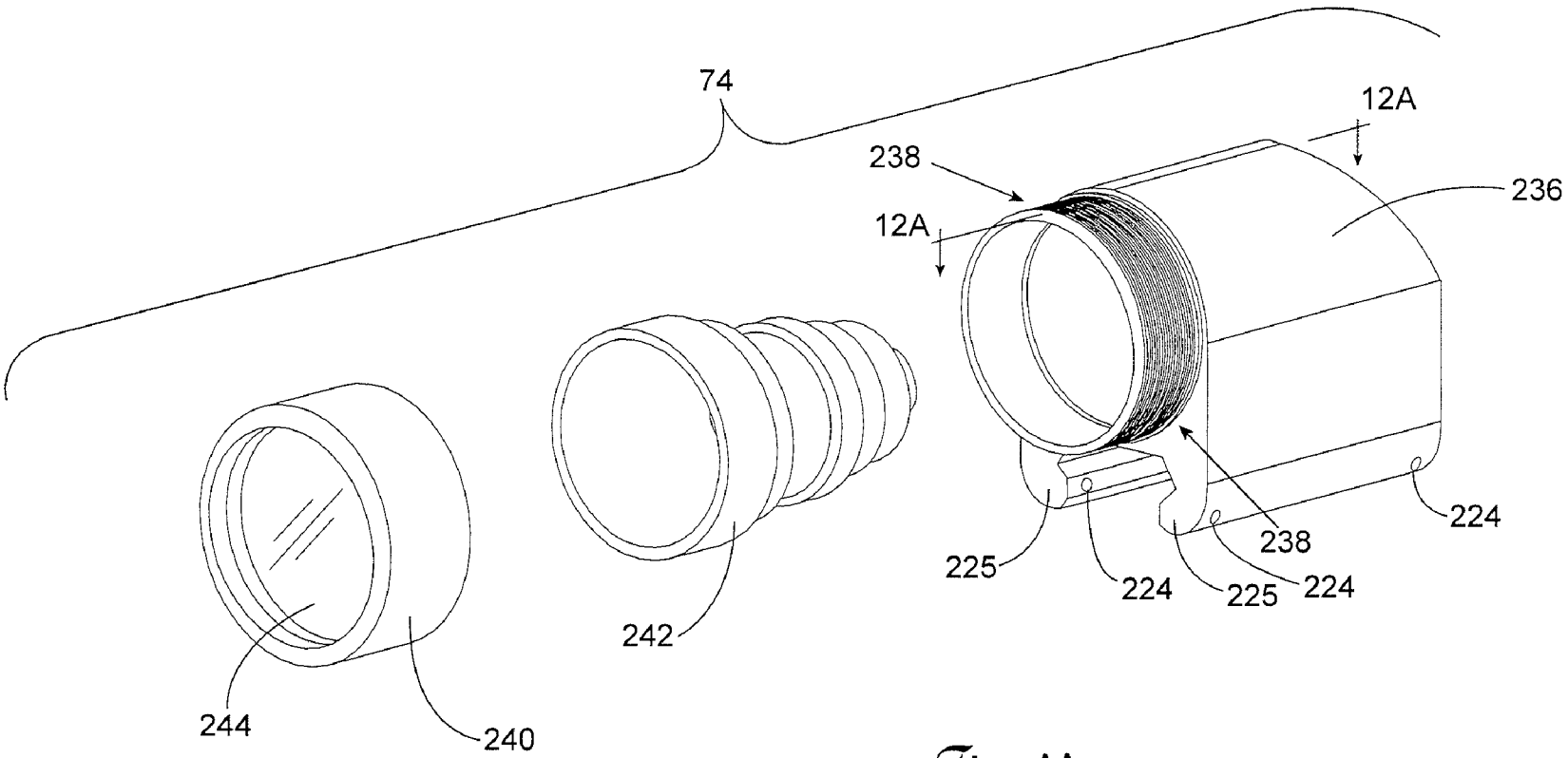
FIG. 11 is an assembly drawing of the light assembly of the preferred embodiment.

FIG. 11 shows the light assembly 74 of the preferred embodiment in greater detail. The light assembly 74 includes a light housing 236 having two bracket fingers 225 shaped to mate with the light mounting rail 72 of the light mount 52 (see FIGS. 7A, 7B). A portion 238 of the light housing 236 is externally threaded to threadedly mate with an internally threaded head unit cap 240 incorporating a lens 244. A head unit 242 for receiving a light bulb is positioned within the light housing 236.

Figure 12A:
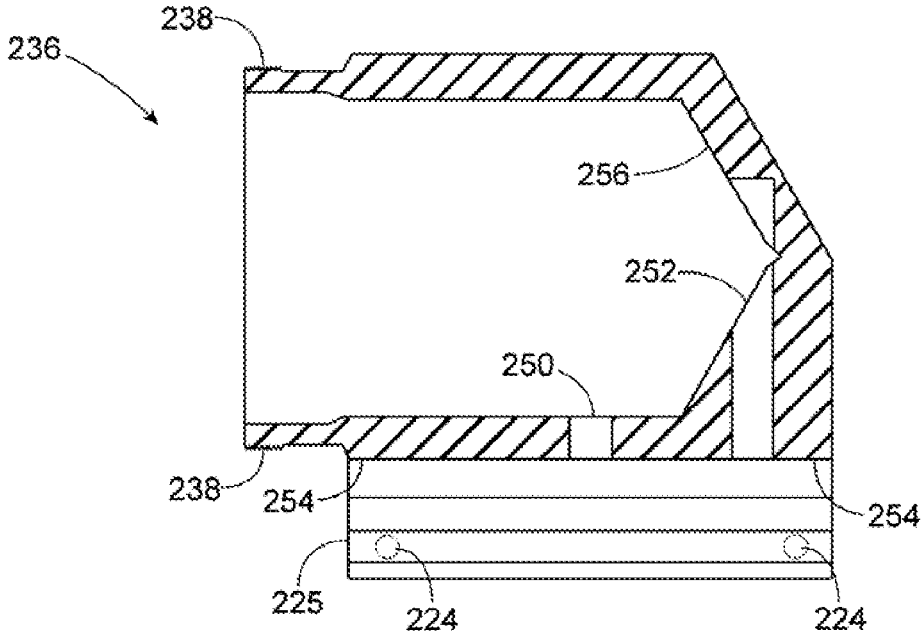
FIG. 12A is a sectional view of the light housing of the preferred embodiment through section line 12A-12A of FIG. 11.
Figure 12B:
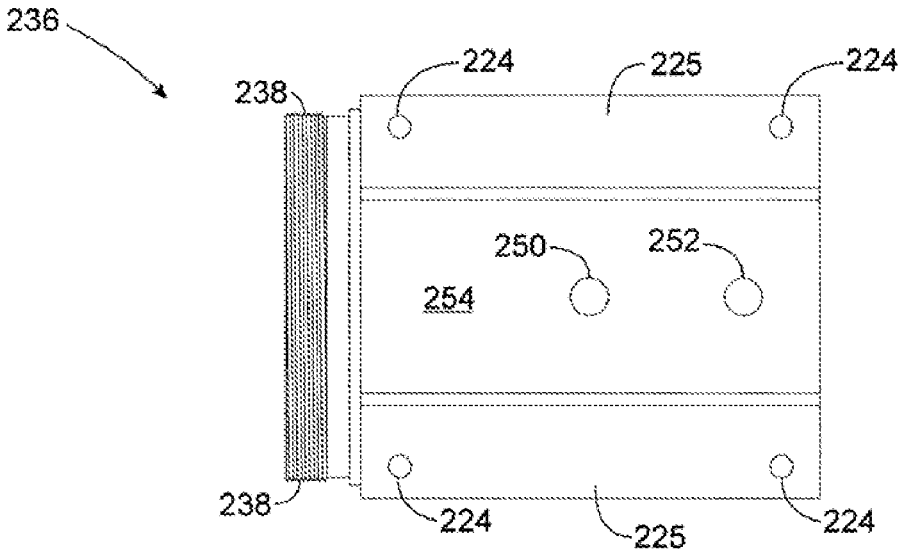
FIG. 12B is bottom elevation of the light housing of the preferred embodiment.

FIGS. 12A and 12B depict a side sectional view through sectional line 12A-12A of FIG. 11 and a bottom elevation view, respectively, of the light housing 236. Proximal and distal conductor slots 250, 252 are disposed through a contact surface 254 of the light housing 236 to receive first and second light conductor pins 220, 222 (see FIGS. 9A & 9B) that provide a current path to and from the head unit 242. The distal conductor slot 252 extends into the rear wall 256 of the light housing 236 to allow contact with the head unit 242 (see FIGS. 9A & 9B). The first light conductor pin 220 contacts the head unit 242 to complete the electrical connection. Mounting holes 224 extending through the bracket fingers 225 allow for attachment of the light housing 236 to the light mounting rail 72 using two mounting pins 228 (see FIGS. 9A & 9B) and an appropriate bonding agent.

In use, and as described hereinabove, the grip mount assembly of the preferred embodiment is rotatable about the stationary mount assembly 26 as desired by the operator. In this manner, the grip assembly 64 may be oriented as desired relative to a floor surface or wall surface to facilitate optimal positioning of the operator (e.g., completely prone). When the light mount assembly 24 is engaged with the grip mount assembly 22 as described with reference to FIG. 10A, the light mount assembly 24 will rotate about the stationary mount assembly 26 with the grip mount assembly 22. When in the disengaged position, as described with reference to FIG. 10B, the grip mount assembly 22 is rotatable about the stationary mount assembly 26 independently from the light mount assembly 24 to facilitate the optimal placement of the light source (or other accessories mounted thereon).

As this disclosure has thus far been made with reference to the structure of the present invention, it will be helpful to the reader to also specifically trace the electrical current path of the preferred embodiment. Referring first to FIG. 5, the positive side of the first battery 176 contacts the compression spring 174, which expands through the insulated hole 172 to couple with the conductive plate 152 through the non-conductive bushing 173. The conductive plate 152 is coupled to the second grip compression spring 139 through the second spring hole 136. As shown in FIG. 4, the second grip compression spring 139 extends through the second spring hole 136 to couple with the second grip conductor pin 112, which extends through the second grip conductor hole 108 into the interior space 58 of the grip mount. The second grip conductor pin 112 contacts the fourth slip ring 80*d*, which is electrically coupled to the second slip ring 80*b* with the positive wire 88, as shown in FIG. 3.

Referring now to FIGS. 9A & 9B, the second slip ring 80*b* is contactable with the second light conductor pin 222 through the second light conductor pin hole 219. The second light conductor pin 222 is urged by the second compression spring 223 into the distal conductor slot 252 of the light housing 236, where it contacts the positive terminal of the head unit 242 (see FIG. 11), which is the electrical load of the circuit. The first light conductor pin 220 is positioned in the proximal conductor slot 250 of the light housing 236, where it contacts the negative terminal of the head unit 242. A current path is provided through the first light conductor pin 220 and the first compression spring 221, which in turn contact the first slip ring 80*a*. The first slip ring 80*a* is electrically connected through the negative wire 86 to the third slip ring 80*c*. Turning now to FIG. 4, the first grip compression spring 138 urges the first grip conductor pin 110 into the interior space 48 of the grip mount 46 to contact the third slip ring 80*c*, thus allowing electrical current to flow to the conductive grip 150. The conductive grip 150 is insulated from the positive current path by the non-conductive bushing 173 and the insulated hole 172. When the pressure-actuated switch 190 is caused to contact the grip 150, electrical connection is establish from the grip 150 through the switch 190 to the negative terminal of the second battery 178, thus completing the circuit and actuating the light assembly 74 (FIGS. 9A & 9B).

The present invention is described above in terms of a preferred illustrative embodiment of a specifically described tactical foregrip assembly 20. Those skilled in the art will recognize that alternative constructions of such an assembly can be used in carrying out the present invention. Other aspects, features, and advantages of the present invention may be obtained from a study of this disclosure and the drawings, along with the appended claims.

We claim:

1. A tactical foregrip assembly for use with a firearm having a barrel and a receiver, the assembly comprising:

a stationary mount assembly attachable to said receiver;

a grip mount assembly having a grip assembly mounted to a grip mount, wherein said grip mount assembly is mounted on and radially rotatable about a portion of said stationary mount assembly; and a light mount assembly mounted on and selectively radially rotatable about said stationary mount assembly independently of said grip mount assembly and having a light assembly mounted thereon.

2. The tactical foregrip assembly of claim 1 further comprising a ball detent subsystem, said ball detent subsystem comprising:

a plurality of proximal detents disposed in said stationary mount assembly;

a plurality of distal detents disposed in said stationary mount assembly;

a light bearing ball disposed within an interior space of said light mount, said light bearing ball alignable with and urged toward said plurality of proximal detents with a light bearing spring, and wherein engagement of said light bearing ball with said plurality of proximal detents inhibits radial rotation of said light mount assembly relative to said stationary mount assembly; and a grip bearing ball disposed within an interior space of said grip mount, said grip bearing ball alignable with and urged toward said plurality of distal detents with a grip bearing spring, wherein engagement of said grip bearing ball with said plurality of distal detents inhibits radial rotation of said grip mount assembly relative to said stationary mount assembly.

3. The tactical foregrip assembly of claim 1 further comprising a voltage source electrically coupled to said electrical switch and adapted to provide power for said light assembly.

4. The tactical foregrip assembly of claim 1 wherein said grip mount assembly includes at least one accessory mounting rail disposed on a peripheral portion thereof and said light mount assembly includes at least one accessory mounting rail disposed on a peripheral portion thereof.

5. The tactical foregrip assembly of claim 1 wherein said grip assembly comprises an electrical switch electrically connectable to said light assembly.

6. The tactical foregrip assembly of claim 1 wherein said stationary mount assembly comprises:

a barrel mount mountable to said receiver of said firearm and having a proximal portion with an outer surface thereof, a plurality of slip rings disposed circumferentially around said outer surface providing an electrical current path between said light mount assembly and said grip assembly; and a barrel nut attached to said barrel mount and adapted to secure said stationary mount assembly to said receiver of said firearm.

7. The tactical foregrip assembly of claim 1 wherein said grip mount comprises:

a proximal base surface having a release pin hole disposed therein; and a release pin slidably positioned in said release pin hole, said release pin being operatively attached to a release button assembly to selectively move said release pin between engaged and disengaged positions.

8. The tactical foregrip assembly of claim 7 wherein an end of said release pin is selectively alignable with said proximal base surface of said grip mount to disengage said light mount assembly from said grip mount assembly.

9. The tactical foregrip assembly of claim 7 wherein said light mount comprises:

a distal base surface having at least one lock pin hole disposed therein;

a lock pin disposed within each of said at least one lock pin hole and alignable with said release pin; and a lock spring disposed within each of said at least one lock pin hole, said lock spring positioned to urge said lock pin from said lock pin hole.

10. The tactical foregrip assembly of claim 9 wherein said lock pin is selectively disposable within said release pin hole to prevent independent rotation of said light mount assembly relative to said grip mount.

11. A tactical foregrip assembly for use with a firearm having a receiver and a barrel, the assembly comprising:

a stationary mount assembly attachable to said receiver of said firearm and having a plurality of conductive slip rings disposed about an outer surface;

a grip mount assembly having a grip assembly mounted to a grip mount, said grip mount assembly being positionable on and radially rotatable about a portion of said stationary mount assembly and electrically connectable to said plurality of slip rings; and a light mount assembly mounted on and selectively radially rotatable about said stationary mount assembly independently of said grip mount assembly and having a light assembly mounted thereon that is electrically connectable to said plurality of slip rings.

12. The tactical foregrip assembly of claim 11 further comprising a ball detent subsystem, said ball detent subsystem comprising:

a plurality of proximal detents disposed in said stationary mount assembly;

a plurality of distal detents disposed in said stationary mount assembly;

a light bearing ball disposed within an interior space of said light mount, said light bearing ball alignable with and urged toward said plurality of proximal detents with a light bearing spring, and wherein engagement of said light bearing ball with said plurality of proximal detents resists radial rotation of said light mount assembly relative to said stationary mount assembly; and a grip bearing ball alignable disposed within an interior space of said grip mount, said grip bearing ball alignable with and urged toward said plurality of distal detents with a grip bearing spring, wherein engagement of said grip bearing ball with said plurality of distal detents resists radial rotation of said grip mount assembly relative to said stationary mount assembly.

13. The tactical foregrip assembly of claim 11 further comprising a voltage source electrically coupled to said electrical switch and adapted to provide power for said light assembly.

14. The tactical foregrip assembly of claim 11 wherein said grip mount assembly includes at least one accessory mounting rail disposed on a peripheral portion thereof and said light mount assembly includes at least one accessory mounting rail disposed on a peripheral portion thereof.

15. The tactical foregrip assembly of claim 11 wherein said grip assembly comprises an electrical switch electrically connectable to said light assembly through said plurality of slip rings.

16. The tactical foregrip assembly of claim 10 wherein said stationary mount assembly comprises:

a barrel mount mountable around said receiver of said firearm and having a proximal portion with an outer surface thereof, each of said plurality of slip rings being disposed circumferentially around said outer surface; and a barrel nut attached to said barrel mount and adapted to secure said stationary mount assembly to said receiver of said firearm.

17. The tactical foregrip assembly of claim 10 wherein said grip mount comprises:

a proximal base surface having a release pin hole disposed therein; and a release pin slidably positioned in said release pin hole, said release pin being operatively attached to a release button assembly to selectively move said release pin between engaged and disengaged positions.

18. The tactical foregrip assembly of claim 17 wherein an end of said release pin is selectively alignable with said proximal base surface of said grip mount to disengage said light mount assembly from said grip mount assembly.

19. The tactical foregrip assembly of claim 17 wherein said light mount comprises:

a distal base surface having at least one lock pin hole disposed therein;

a lock pin disposed within each of said at least one lock pin hole and alignable with said release pin; and a lock spring disposed within each of said at least one lock pin hole, said lock spring positioned to urge said lock pin from said lock pin hole.

20. The tactical foregrip assembly of claim 19 wherein said lock pin is selectively disposable within said release pin hole to prevent independent rotation of said light mount assembly relative to said grip mount.

21. The tactical foregrip assembly of claim 1 wherein said barrel mount, said grip mount, and said light mount are concentrically aligned.

22. The tactical foregrip assembly of claim 11 wherein said barrel mount, said grip mount, and said light mount are concentrically aligned.

23. The tactical foregrip assembly of claim 5 wherein said electrical switch is pressure-actuated, displacement-actuated, or force-actuated.

24. The tactical foregrip assembly of claim 10 wherein said electrical switch is pressure-actuated, displacement-actuated, or force-actuated.

* * * * *